US006581383B2

(12) United States Patent
Dirauf et al.

(10) Patent No.: US 6,581,383 B2
(45) Date of Patent: Jun. 24, 2003

(54) POWER STATION, IN PARTICULAR INDUSTRIAL POWER STATION

(75) Inventors: Peter Dirauf, Erlangen (DE); Wolfgang Kiefer, Erlangen (DE); Andreas Leuze, Effeltrich (DE); Herbert Menapace, Erlangen (DE); Peter Madl, Forchheim (DE); Jens Rosenkranz, Hettstedt (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/073,556

(22) Filed: Feb. 11, 2002

(65) Prior Publication Data

US 2002/0088232 A1 Jul. 11, 2002

Related U.S. Application Data

(63) Continuation of application No. PCT/DE00/02506, filed on Jul. 28, 2000.

(51) Int. Cl.[7] ..... F01K 13/00
(52) U.S. Cl. ..... 60/645; 60/668; 60/670
(58) Field of Search ..... 60/645, 668, 670

(56) References Cited

U.S. PATENT DOCUMENTS

| | | | | |
|---|---|---|---|---|
| 3,925,679 A | | 12/1975 | Berman et al. | |
| 4,965,880 A | * | 10/1990 | Petitjean | 700/112 |
| 5,656,491 A | * | 8/1997 | Cassani et al. | 422/129 |
| 6,362,744 B1 | * | 3/2002 | Benke et al. | 340/635 |

FOREIGN PATENT DOCUMENTS

| | | |
|---|---|---|
| EP | 0 849 435 A2 | 6/1998 |
| FR | 2 452 196 | 3/1979 |

* cited by examiner

*Primary Examiner*—Hoang Nguyen
(74) *Attorney, Agent, or Firm*—Laurence A. Greenberg; Werner H. Stemer; Ralph E. Locher

(57) ABSTRACT

A power station is formed of a plurality of mobile modules. One of the mobile modules is a connecting module which has only connecting lines, control equipment, cut-off equipment and measuring equipment installed therein. The connection module can be used for different power stations, which allows a cost-effective construction of power stations. Further, fittings which have to be monitored and operated are concentrated in the connecting module, which reduces operating costs of the power station.

11 Claims, 1 Drawing Sheet

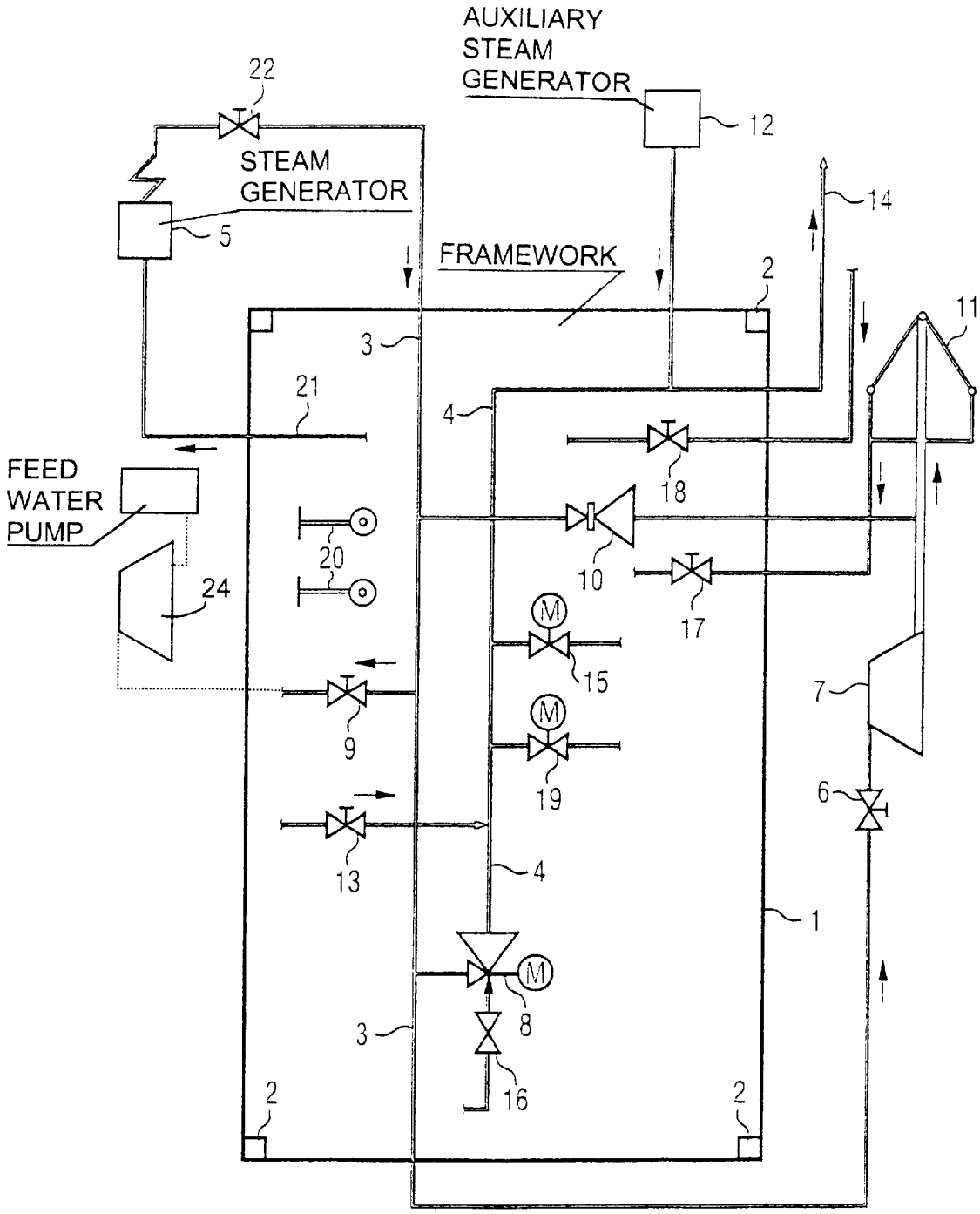
AUXILIARY
STEAM
GENERATOR
12
22
STEAM
GENERATOR
5
14
FRAMEWORK
2
11
3
21
4
18
FEED
WATER
PUMP
20
10
24
17
15
7
9
19
6
13
4
1
8
3
16
2
2

POWER STATION, IN PARTICULAR INDUSTRIAL POWER STATION

CROSS-REFERENCE TO RELATED APPLICATION

This application is a continuation of copending International Application PCT/DE00/02506, filed Jul. 28, 2000, which designated the United States.

BACKGROUND OF THE INVENTION

Field of the Invention

The invention relates to a power station, in particular an industrial power station, formed of mobile modules of which one is configured as a connecting module.

When building power station installations, for example industrial power stations, it has been usual practice that specialists prepare new plans for each project. The necessary expenditures for this process of planning and building power stations are very high even at the stage when quotes for the power station are made. The development of solutions specific to the project is expensive, mainly because each specialist department has to make new plans and layouts for each project and because, during the manufacture and building of the power station, a large number of individual parts have to be manufactured individually.

Attempts to reduce the expenditure involved in this have, in the past, been made by specialists taking over as many relevant activities and existing components as possible from earlier or similar projects for use in newer projects.

U.S. Pat. No. 3,925,679 discloses a modular power station which includes a central control module. The control module includes a plurality of monitoring devices, control devices, energy supply devices, and actuating devices. The control module is tailored to the specific needs of the respective power station and an identical control module cannot be used for different power stations in a modular manner. As a result, the planning and building of the power station requires increased expenditures. Also, central power station devices are distributed among different modules of the power station. This makes in particular the operation of the installation more difficult.

SUMMARY OF THE INVENTION

It is accordingly an object of the invention to provide a power station which overcomes the above-mentioned disadvantages of the heretofore-known power stations of this general type and which is simple to plan and erect and also simple to operate.

With the foregoing and other objects in view there is provided, in accordance with the invention, a power station, in particular an industrial power station, including:

a plurality of mobile modules; and one of the mobile modules being configured as a connecting module, the connecting module having only connecting lines, control equipment, cut-off equipment and measuring equipment installed therein.

In other words, the object of the invention is achieved by, in addition to connecting lines, it is exclusively pipework fittings and measuring equipment which are installed in the connecting module. In this configuration, the connecting module is formed, at its core, of a framework which is open on all sides, in which framework a continuous connecting line acts as a live steam line, adjacent to which a process steam line is provided.

The live steam line is fed from a steam generator and, for its part, supplies a turbine with live steam as well as supplying the process steam line via a conversion station and, via at least one shut-off valve, at least one turbine for driving a feed water pump. In addition, the live steam line is connected to a line between the turbine and a condenser via at least one turbine bypass with a pressure reducing unit.

Both steam from an auxiliary steam generator and exhaust steam from a turbine for driving a feed water pump, in addition to steam from the conversion station, are supplied to the process steam line. In order to control the steam condition of the live steam fed, via a conversion station, into the process steam line, water can be admitted to the conversion station. The process steam line can also be used for supplying a district heating installation.

One condensate line each for condensate from the turbine exhaust steam and from the process exhaust steam opens into the connecting module in which, in addition, at least one suction line and one pressure line with fittings are provided in each case for feed water, the process steam line having a connection within the connecting module, which connection is connected via a valve to a degassing line.

According to a further feature of the invention, the live steam line is fed from a steam generator and, for its part, supplies a turbine with live steam as well as supplies the process steam line via a conversion station and, via at least one shut-off valve, at least one turbine for driving a feed water pump.

According to another feature of the invention, the live steam line is connected to a line between the turbine and a condenser via at least one turbine bypass with a pressure reducing unit.

According to yet another feature of the invention, steam from an auxiliary steam generator and exhaust steam from a turbine for driving a feed water pump, in addition to steam from the conversion station, are fed into the process steam line.

According to another feature of the invention, water can be admitted to the conversion station via a shut-off valve.

According to another feature of the invention, a condensate line for condensate from turbine exhaust steam and a condensate line for condensate from process exhaust steam open into the connecting module.

According to a further feature of the invention, at least one suction line and one pressure line with fittings are provided in each case for feed water in the connecting module.

According to another feature of the invention, the process steam line has a connection within the connecting module, which connection is connected via a valve to a degassing line.

The embodiment, according to the invention, of a connecting module for a power station of modular construction is advantageous because, by this measure, a clear configuration of the fittings and logistically simple operation of the same is ensured, in addition to a simple planning system which can be repeatedly employed.

Other features which are considered as characteristic for the invention are set forth in the appended claims.

Although the invention is illustrated and described herein as embodied in a power station, in particular industrial power station, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The single FIGURE is a schematic representation of an exemplary embodiment of a power station with a connecting module according to the invention.

DESCRIPTION OF THE PREFERRED EMBODIMENTS

Referring now to the single FIGURE of the drawing in detail, there is shown a framework 1 made from any given profile sections that forms an outer frame for a connecting module and has the shape of a cuboid. The vertical edges of this cuboid are formed from particularly strong profile sections 2, for example tubes of square cross section. The external dimensions of the framework 1 preferably correspond to those of a conventional transport container. Apart from the load-carrying profile sections of the framework 1, its walls are essentially open. Arrows near connecting lines indicate the flow direction of a medium in the respective connecting line.

A live steam line 3 and a process steam line 4 are installed adjacent to one another in the longitudinal direction in the framework 1. Both the pressure and the temperature of the steam in the live steam line 3 are, as a rule, higher than the corresponding values for the steam in the process steam line 4.

The live steam line 3 is fed from a steam generator 5 and, for its part, feeds a turbine 7 via a turbine inlet adjusting valve 6. In addition, the live steam line 3 is connected, via a conversion station 8, to the process steam line 4 and supplies, via a shut-off valve 9, at least one turbine 24 for driving a feed water pump.

There is, in addition, a connection, via a pressure reducing unit 10, from the live steam line 3 to an exhaust steam line from the turbine 7 to a condenser 11, which is preferably embodied as an air-cooled condenser. Tapping lines for heating condensate and/or feed water, which may possibly be branched off from the turbine 7, are likewise routed through the connecting module, but are not represented in the drawing for reasons of clarity.

Apart from steam obtained via the conversion station 8, the process steam line 4 also obtains steam from an auxiliary steam generator 12 and, via a line with a shut-off valve 13, exhaust steam from at least one turbine which drives a feed water pump. Steam is released from the process steam line 4 into a line 14 of a process steam cycle leading out of the power station and leading, via a control valve 15, to a district heating installation. So that the steam condition in the process steam line 4 can be adjusted, the latter can be connected via a shut-off valve to a water line.

A condensate line from the condenser 11 opens into a condensate fitting 17 and a condensate line from the process steam cycle opens into a condensate fitting 18. In order to ensure interference-free operation, the process steam line 4 can, in addition, be connected via a valve 19 to a line leading to a degasser.

At least one suction line 20 and one pressure line 21 for boiler feed water are also routed in each case through the connecting module and have fittings there.

Outside the connecting module, the live steam line is provided with an adjustment valve 22 at the outlet from the steam generator 5.

Each of the lines from and to the connecting module is connected at a flange connection or welded connection, each of which is preferably flush with one of the outer surfaces of the connecting module.

Although connecting modules configured according to the invention are preferably provided for industrial power stations, they can also be used in any other manufacturing installation.

We claim:

1. A power station, comprising:

a plurality of mobile modules;

one of said mobile modules being configured as a connecting module, said connecting module having only connecting lines, control equipment, cut-off equipment and measuring equipment installed therein;

one of said connecting lines being a continuous connecting line serving as a live steam line; and another of said connecting lines being a process steam line disposed adjacent said live steam line.

2. The power station according to claim 1, wherein said connecting module is configured as a framework that is substantially all-around open.

3. The power station according to claim 1, including:

steam generator feeding said live steam line;

a turbine, said live steam line feeding live steam to said turbine;

a conversion station, said live steam line feeding, via said conversion station, live steam to said process steam line;

at least one shut-off valve; and at least one further turbine for driving a feed water pump, said live steam line feeding, via said at least one shut-off valve, said at least one further turbine.

4. The power station according to claim 1, including:

a turbine;

a condenser;

a line connecting said turbine and said condenser;

at least one turbine bypass with a pressure reducing unit; and said live steam line being connected, via said at least one turbine bypass, to said line between said turbine and said condenser.

5. The power station according to claim 1, including:

an auxiliary steam generator;

a turbine for driving a feed water pump; and a conversion station, said process steam line being fed with steam from said conversion station, steam from said auxiliary steam generator and exhaust steam from said turbine for driving a feed water pump.

6. The power station according to claim 1, including:

a conversion station connected to said process steam line; and a shut-off valve, connected to said conversion station, for admitting water to said conversion station.

7. The power station according to claim 1, including:

a district heating line connected to said process steam line; and said process steam line feeding steam to said district heating line.

8. The power station according to claim 1, including a first condensate line for condensate from turbine exhaust steam and a second condensate line for condensate from process exhaust steam, said first and second condensate lines being directed into said connecting module.

9. The power station according to claim 1, wherein said connecting module includes at least one suction line and at least one pressure line with fittings for feed water.

10. The power station according to claim 1, wherein:

said process steam line has a connection within said connecting module; and a valve connects said connection of said process steam line to a degassing line.

11. The power station according to claim 1, wherein said mobile modules form an industrial power station.

* * * * *

UNITED STATES PATENT AND TRADEMARK OFFICE

CERTIFICATE OF CORRECTION

PATENT NO. : 6,581,383 B2
DATED : June 24, 2003
INVENTOR(S) : Peter Dirauf et al.

It is certified that error appears in the above-identified patent and that said Letters Patent is hereby corrected as shown below:

Title page,
Item [30], Related Application Priority Data, should read as follows:

-- Aug. 10, 1999 (DE) …….. 199 37 789 --

Signed and Sealed this

Seventh Day of October, 2003

JAMES E. ROGAN
*Director of the United States Patent and Trademark Office*